US009526360B2

(12) United States Patent
Sternlight et al.

(10) Patent No.: US 9,526,360 B2
(45) Date of Patent: Dec. 27, 2016

(54) TRAVEL PILLOW

(71) Applicant: CABEAU, INC., Woodland Hills, CA (US)

(72) Inventors: David Bret Sternlight, Woodland Hills, CA (US); Kyna Rose Sternlight, Woodland Hills, CA (US)

(73) Assignee: CABEAU, INC., Woodland Hills, CA (US)

( * ) Notice: Subject to any disclaimer, the term of this patent is extended or adjusted under 35 U.S.C. 154(b) by 0 days.

(21) Appl. No.: 14/394,259

(22) PCT Filed: Apr. 8, 2013

(86) PCT No.: PCT/US2013/035646
§ 371 (c)(1),
(2) Date: Oct. 13, 2014

(87) PCT Pub. No.: WO2013/155003
PCT Pub. Date: Oct. 17, 2013

(65) Prior Publication Data

US 2015/0082546 A1 Mar. 26, 2015

Related U.S. Application Data

(63) Continuation of application No. 13/488,443, filed on Jun. 4, 2012.

(Continued)

(51) Int. Cl.
*A47G 9/10* (2006.01)
*A47C 7/38* (2006.01)

(52) U.S. Cl.
CPC ..... *A47G 9/10* (2013.01); *A47C 7/383* (2013.01); *A47G 2009/1018* (2013.01)

(58) Field of Classification Search
CPC A47G 2009/1018; A47G 9/10; A47G 9/1027; A47G 9/1045; A47G 9/1081; A47C 7/383
See application file for complete search history.

(56) References Cited

U.S. PATENT DOCUMENTS 15,581 A 8/1856 Slaughter ..... 297/393
1,468,072 A 9/1923 Ogle ..... 5/654
(Continued)

FOREIGN PATENT DOCUMENTS

AU 76466/91 † 11/1991
AU 199176466 11/1991
(Continued)

OTHER PUBLICATIONS

Form PCT/ISA/210 International Search Report for PCT/US2013/035646 dated Jul. 18, 2013.

(Continued)

*Primary Examiner* — David E Sosnowski
*Assistant Examiner* — Amanda L Miller
(74) *Attorney, Agent, or Firm* — Koppel, Patrick, Heybl & Philpott

(57) ABSTRACT

The present invention discloses a U-shaped travel pillow having a base cushion and raised cushion fixed to the top side of the base cushion. The inner peripheral walls of the base and raised cushions are mutually flush, while the rear walls are mutually flush and substantially flat for better contact with flat surfaces, such as a headrest, seat, or chair. Furthermore, the rear wall of the raised cushion is thinner than the sides, providing more liberty to adjust head position by easily adapting to the shape of the headrest, seat or chair. A removable cover is adapted to cover the base and raised cushions, while a drawstring with an adjustable cinch mechanism can be used for adjusting the travel pillow around the neck.

5 Claims, 3 Drawing Sheets

Related U.S. Application Data

(60) Provisional application No. 61/623,545, filed on Apr. 12, 2012.

(56) References Cited

U.S. PATENT DOCUMENTS

| | | | | |
|---|---|---|---|---|
| 1,787,832 | A | 5/1929 | Mueller | |
| D169,631 | S | 5/1953 | Norman et al. | |
| 2,774,601 | A | 12/1956 | White | |
| 3,164,151 | A | 1/1965 | Esmond | |
| 3,327,330 | A | 6/1967 | McCullough | |
| D98,859 | S | 1/1970 | Fast | |
| 4,031,578 | A | 6/1977 | Sweeney et al. | |
| D256,728 | S † | 9/1980 | Allen | |
| 4,285,081 | A | 8/1981 | Price | |
| D263,625 | S | 3/1982 | McKnight | |
| 4,345,347 | A * | 8/1982 | Kantor | 5/644 |
| 4,887,326 | A | 12/1989 | O'Brien et al. | |
| 5,313,678 | A | 5/1994 | Redewill | 5/639 |
| D368,527 | S | 4/1996 | Brooke | |
| D396,594 | S † | 8/1998 | Lefebvre | |
| D396,980 | S * | 8/1998 | Novros | D6/601 |
| D404,238 | S | 1/1999 | Keilhauer | |
| D414,974 | S † | 10/1999 | Marrone | |
| D416,745 | S † | 11/1999 | Noyes | |
| 5,974,607 | A | 11/1999 | Smith | 5/636 |
| D419,024 | S | 1/2000 | Lenahan | |
| 6,010,192 | A * | 1/2000 | King | 297/397 |
| D420,845 | S † | 2/2000 | Rumage | |
| 6,219,865 | B1 | 4/2001 | Stokesbary | |
| 6,230,348 | B1 | 5/2001 | Patrikakis | 5/636 |
| 6,230,349 | B1 | 5/2001 | Silver et al. | |
| D443,461 | S | 6/2001 | Hall | |
| D444,981 | S | 7/2001 | Hall | |
| D445,624 | S | 7/2001 | Futagami | D6/604 |
| D446,863 | S | 8/2001 | Carroll | |
| 6,408,468 | B1 * | 6/2002 | Comfort | 5/636 |
| 6,435,617 | B1 * | 8/2002 | McNair | 297/397 |
| 6,447,468 | B1 | 9/2002 | Hankins et al. | 602/18 |
| D481,247 | S | 10/2003 | Roberts et al. | D6/604 |
| 6,658,681 | B2 | 12/2003 | Britto et al. | 5/655 |
| D486,028 | S | 2/2004 | Cathey | |
| D501,349 | S | 2/2005 | Harris | |
| D503,062 | S † | 3/2005 | Nash | |
| 6,926,686 | B2 | 8/2005 | Cheatham | |
| D522,300 | S | 6/2006 | Roberts | |
| 7,185,378 | B2 | 3/2007 | Smith | 5/642 |
| 7,225,485 | B2 | 6/2007 | Binder | 5/644 |
| D550,495 | S | 9/2007 | Boutin | |
| D567,562 | S † | 4/2008 | Nash | |
| 7,437,788 | B1 * | 10/2008 | Holman | 5/636 |
| D582,045 | S | 12/2008 | James | |
| D582,713 | S | 12/2008 | Baldwin | D6/601 |
| D597,364 | S | 8/2009 | Lindgren | |
| D607,682 | S | 1/2010 | Presman | |
| D619,402 | S * | 7/2010 | Sternlight et al. | D6/601 |
| 7,779,492 | B2 | 8/2010 | Mangano | 5/482 |
| 7,788,752 | B2 * | 9/2010 | Tidwell et al. | 5/655 |
| 7,865,987 | B2 | 1/2011 | Deetsch | 5/640 |
| 7,909,406 | B2 | 3/2011 | Samuelsen | 297/397 |
| D637,439 | S † | 5/2011 | Mettler | |
| D637,440 | S | 5/2011 | Mettler | |
| D647,624 | S | 10/2011 | Thorgilsdottir | |
| 8,144,913 | B1 * | 3/2012 | Myles, Jr. | 381/374 |
| 8,239,987 | B2 | 8/2012 | Sharp | 5/639 |
| 8,316,488 | B2 | 11/2012 | Rojas | |
| 8,321,977 | B1 * | 12/2012 | Kummerfeld et al. | 5/636 |
| 8,584,285 | B1 * | 11/2013 | Sipherd | A47C 7/383 5/636 |
| 2001/0054837 | A1 | 12/2001 | O'Connor | |
| 2003/0137178 | A1 | 7/2003 | Craft et al. | 297/452.41 |
| 2005/0150050 | A1 | 7/2005 | Wolf et al. | 5/636 |
| 2005/0179300 | A1 | 8/2005 | O'Connor et al. | 297/391 |
| 2005/0229498 | A1 | 10/2005 | Eichin | 5/244 |
| 2007/0033737 | A1 * | 2/2007 | Melton | 5/640 |
| 2007/0056107 | A1 | 3/2007 | Gabriel | |
| 2007/0067915 | A1 * | 3/2007 | Pryor | 5/636 |
| 2007/0271703 | A1 | 11/2007 | Brown et al. | 5/636 |
| 2008/0104764 | A1 * | 5/2008 | Chen | 5/644 |
| 2008/0216244 | A1 * | 9/2008 | Minton | 5/640 |
| 2009/0013471 | A1 | 1/2009 | Yang | 5/640 |
| 2009/0133193 | A1 | 5/2009 | Weise | 5/640 |
| 2010/0133888 | A1 | 6/2010 | Montuore | |
| 2011/0235832 | A1 * | 9/2011 | Riopel | 381/300 |
| 2011/0314609 | A1 | 12/2011 | Lee | 5/655.3 |
| 2012/0011655 | A1 † | 1/2012 | Rojas | |
| 2012/0144590 | A1 * | 6/2012 | Sharp | 5/639 |
| 2013/0125312 | A1 | 5/2013 | Harooni | 5/639 |
| 2013/0232693 | A1 | 9/2013 | Myers | 5/636 |
| 2015/0257555 | A1 | 9/2015 | Wong | |

FOREIGN PATENT DOCUMENTS

| | | | |
|---|---|---|---|
| AU | 2003201842 | | 10/2003 |
| CM | 3238498 | | 5/2002 |
| CM | 300941334 | | 6/2009 |
| CM | 301137730 | | 2/2010 |
| CN | 86300949 | | 5/1987 |
| CN | 3006418 | | 9/1990 |
| CN | 3010592 | | 9/1991 |
| CN | 3015753 | | 10/1992 |
| CN | 3052608 | | 12/1996 |
| CN | 013590715 | | 12/2001 |
| CN | 3289601 | | 4/2003 |
| CN | 3435056 | | 3/2005 |
| CN | 3440171 | | 4/2005 |
| CN | 3476279 | | 9/2005 |
| CN | 2836650 | | 11/2005 |
| CN | 3487002 | | 11/2005 |
| CN | 3497652 | | 1/2006 |
| CN | 2006301323942 | | 6/2006 |
| CN | 3563694 | | 9/2006 |
| CN | 3578942 | | 11/2006 |
| CN | 3614520 | | 2/2007 |
| CN | 30069083 4 | | 9/2007 |
| CN | 300685967 | | 9/2007 |
| CN | 300707538 | | 11/2007 |
| CN | 300711427 | | 11/2007 |
| CN | 300774484 | | 5/2008 |
| CN | 300811885 | | 8/2008 |
| CN | 300882439 | | 2/2009 |
| CN | 300892694 | | 3/2009 |
| CN | 300959418 | | 7/2009 |
| CN | 301025929 | | 9/2009 |
| CN | 301109905 | | 1/2010 |
| CN | 301151430 | | 3/2010 |
| CN | 102166088 | | 8/2011 |
| CN | 20201493 7 | | 10/2011 |
| CN | 202014937 | U | 10/2011 |
| FR | 1076118 | | 10/1954 |
| GB | 2290705 | | 1/1996 |
| GB | 2055656 | † | 8/1996 |
| JP | 200015308 | | 10/2001 |
| JP | 3132278 | | 5/2007 |
| JP | 1543718 | | 2/2015 |
| KR | 3019990015333 | | 2/2000 |
| KR | 3020000029799 | | 5/2001 |
| KR | 3020010000482 | | 8/2001 |
| KR | 3020010007585 | | 8/2001 |
| KR | 20050019575 | A | 3/2005 |
| KR | 20050019757 | | 3/2005 |
| KR | 200424871 | | 8/2006 |
| KR | 3020070002191 | | 1/2007 |
| KR | 3020080018019 | | 5/2008 |
| KR | 3020080039948 | | 10/2008 |
| KR | 3020080049371 | | 11/2008 |
| KR | 3008249610000 | | 11/2015 |
| RU | 34338 | U1 | 12/2003 |
| WO | WO 2011122769 | | 10/2011 |

OTHER PUBLICATIONS

Office Action from U.S. Appl. No. 13/488,443. dated Apr. 18, 2014.

(56) References Cited

OTHER PUBLICATIONS

Office Action from U.S. Appl. No. 13/488.443, dated Jul. 23, 2015.
Office Action from U.S. Appl. No, 13/488,443, dated Oct. 29, 2314.
Response to Office Action from U.S. Appl. No. 13/488,433, dated Apr. 28, 2015.
Response to Office Action from U.S. Appl. No. 13/488,433. dated Sep. 18, 2014.
Response to Office Action from U.S. Appl. No. 13/488,433, dated Dec. 12, 2014.
Examination from European Patent Appl. No. 13 745 557.2, dated Jun. 12, 2015.
Third Party Submittal, Kirby IP Canada, dated Sep. 18, 2015.
Third Party Observation from International Appl. No PCT/US2013/035646, dated Jun. 16, 2014.
Third Party Observation from Australian Appl. No. AU2014100424. dated Jun. 18, 2014.
Patent Examination Report No. 2, from Australian Patent Appl. No. 2013206536, dated Jan. 16, 2015.
Supplementary European Search Report from Appl. No. EP13745557, dated Sep. 15, 2014.
Third Party Observation for Appl. No. EP20130745557. dated Jun. 14, 2014.
Notice of Preliminary Rejection from Korean Patent Appl. No. 1-2013-7034274. dated Jul. 2, 2015.
Second Office Action from Chinese Patent Appl. No. 2013800005476, dated May 11, 2015.
Invitation to Respond to Written Opinion, Written Opinion and Search Report from Singapore Patent Appl. No. 11201406500T, dated Apr. 14, 2015.
Office Action from Columbian Patent Appl. No. 14-249922-4, dated Jun. 16, 2016.
Notice of Final Rejection from Korean Patent Appl. No 10-2013-7034274. dated Apr. 15, 2016.
First Office Action (summary) from Mexican Design Appl. No. Mx/f/2015/001297. dated Mar. 14, 2016.
Notice of Allowance and Search Report from Taiwanese Patent Appl. No. 104302012, dated Apr. 20, 2016.
Third party observations on Great Britain Appl. No. GB1418089.7 dated Jun. 23, 2016.
Examination from European Patent Appl. No. 13 745 557.2-1653, dated Mar. 7, 2016.
Third Party Observations filed with the Australian IP against Australian Patent Appl. No. 2015202263 and received Feb. 23, 2016.
Office Action from U.S. Appl. No. 13/488,443, dated Feb. 11, 2016.
Office Action from U.S. Appl. No. 13/488,443, dated Apr. 18, 2014.
Office Action from U.S. Appl. No. 13/488,443, dated Jul. 23, 2015.
Office Action from U.S. Appl. No. 13/488,443, dated Oct. 29, 2014.
Third Party Observations from corresponding UK Patent appl. No. 1418089.7, dated Oct. 27, 2015.
3rd party observations filed against European Patent Application No. 13745557.2, filed on Oct. 26, 2016.

* cited by examiner
† cited by third party

TRAVEL PILLOW

CROSS-REFERENCE TO RELATED APPLICATIONS

This application claims priority to PCT/US2013/035646 filed on Apr. 8, 2013, which claims the benefit of U.S. Provisional Patent Application 61/623,545, filed on Apr. 12, 2012, and U.S. Utility patent application Ser. No. 13/488,443, filed on Jun. 4, 2012, all three of which are incorporated herein by reference in their entirety.

FIELD OF THE INVENTION

This invention relates to pillows, and more particularly to a travel pillow.

DISCUSSION OF RELATED ART

A pillow generally provides support for the head and neck, typically in a laying position. A travel pillow, conversely, is designed to provide support for the head and neck while seated, as is common during long automobile, train, and airplane trips. A travel pillow is generally "U" shaped and is adapted to fit around the neck of a person. A travel pillow can prevent neck strain and promote comfort by supporting a person's neck and head vertically.

U.S. Pat. No. 6,230,349 to Silver et al. on May 15, 2001, describes a travel pillow having a compact size and U-shape for cradling the head and neck of a user while sitting. This device is adapted to allow the user to allow or remove fill material in order to adjust firmness. While this invention is capable of providing neck support, it does not provide adequate neck support in left, right, and forward positions. Furthermore, this travel pillow will force the person's head forward, causing neck strain, as there is no support in the front. The lobes, moreover, are not tall enough, and the lobes will split out if one's head falls left or right.

U.S. Pat. No. 4,345,347 to Kantor on Aug. 24, 1982, describes a cushion having a U-shaped portion for supporting the head and neck of a user while sitting. This device is adapted to accept a sleeve to cover parts of the cushion that will touch skin or hair, and includes weights for balancing the device on the shoulders. While this invention is capable of providing neck support, it does not provide adequate neck support in left, right, and forward positions and is not adapted to prevent an extreme forward head position.

U.S. Pat. No. 98,859 to Fast on Jan. 18, 1870, describes a travel pillow having a cushion for promoting the comfort of passengers while traveling. This device comprises an inflatable semi-circular cushion and a strap adapted to form the cushion around the neck by applying downward force with the arms. While this invention is capable of providing neck support, it does not provide adequate neck support in left, right, and forward positions and is not adapted to prevent an extreme forward head position.

While several travel pillows exist in the prior art, few provide adequate support for alternative head positions. Furthermore, travel pillows are notorious for forcing the head forward, causing neck strain. Finally, current travel pillows do not adequately support a front position due to the gap of the "U" shape. Therefore, there is a need for a travel pillow that can provide adequate neck support for all head positions without causing undue strain. Furthermore, a need exists for a travel pillow that will not force the head forward in a rearward position. The present invention accomplishes these objectives.

SUMMARY OF THE INVENTION

The present invention discloses a travel pillow comprising a U-shaped, pliable base cushion with a second U-shaped raised cushion fixed to the top side of the base cushion. The inner peripheral walls of the base and raised cushions are mutually flush, providing a comfortable surface for the neck. Furthermore, the rear walls of the base and raised cushions are mutually flush and substantially flat for better contact with flat surfaces, such as a headrest, seat, or chair. The rear portion of the raised cushion is thinner than each side portion of the raised cushion, providing more liberty to adjust head position by easily adapting to the shape of the headrest, seat or chair. A removable cover is adapted to cover the base and raised cushions. The cover is reversible, where the outside of the cover has a contrasting appearance to the inside of the cover.

The raised cushion is ergonomically designed to comfortably fit around the neck without causing undue strain. Furthermore, the raised cushion is adapted to prevent interfere with a person wearing headphones. Pockets can be positioned on the outside and bottom of the base cushion for storing electronic devices and other objects. A drawstring with an adjustable cinch mechanism can be used for adjusting the travel pillow around the neck. The cinch mechanism also keeps the pillow in place, prevents the lobes from splitting outward, and conforms the pillow around one's neck. Further, the cinch mechanism allows attachment of the pillow around a bag handle or strap for hands-free transport.

The U-shape of the travel pillow is generally intended to provide support to the head while traveling. As such, the base cushion and raised cushions are integrally formed from a memory foam material adapted to fit securely, yet comfortably, around the neck, providing adequate ergonomic support to the head when seated in an upright position. The travel pillow can be shaped like an animal, character, or sports team logo.

The present device is a travel pillow that can provide adequate neck support for all head positions without causing undue strain. Furthermore, a need exists for a travel pillow that will not force the head forward in a rearward position. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
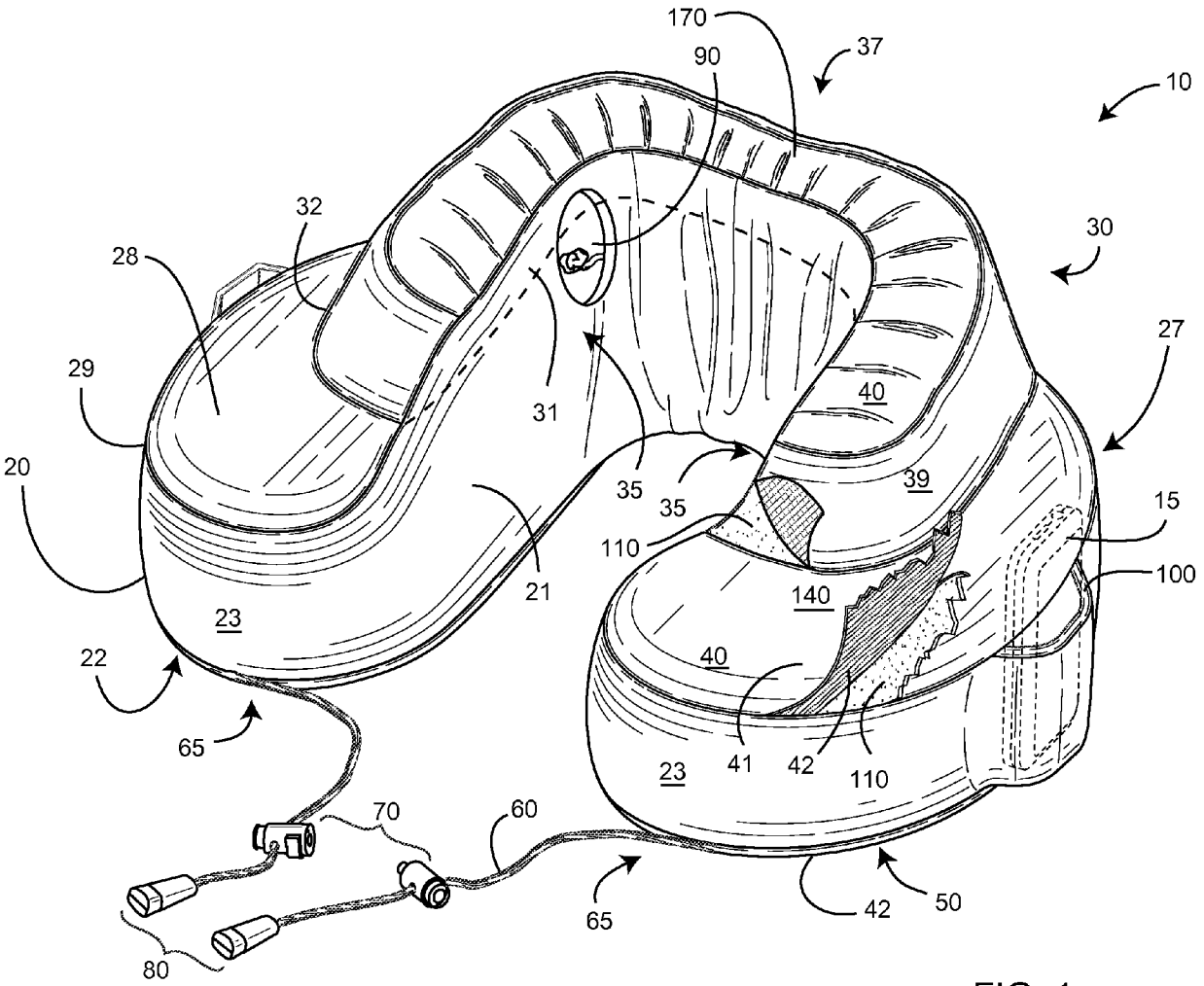
FIG. 1 is a perspective view one embodiment of the invention.
Figure 2:
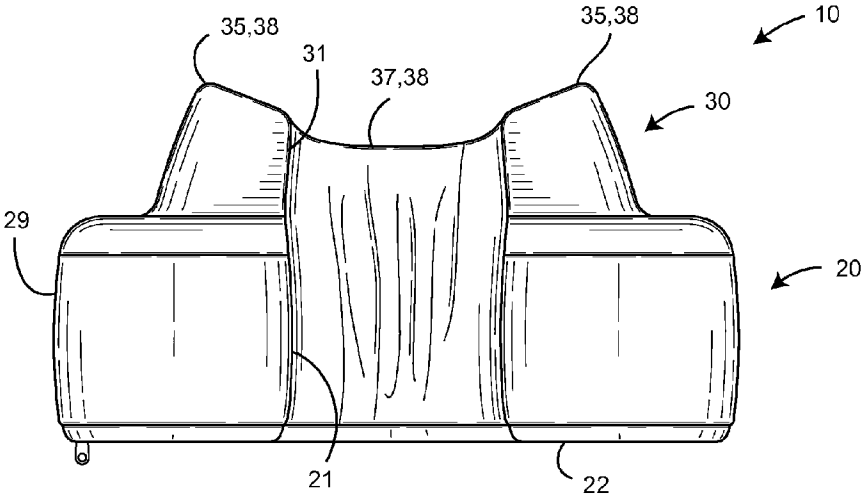
FIG. 2 is a front elevational view thereof, a drawstring illustrated in FIG. 1 omitted for clarity of illustration.
Figure 4:
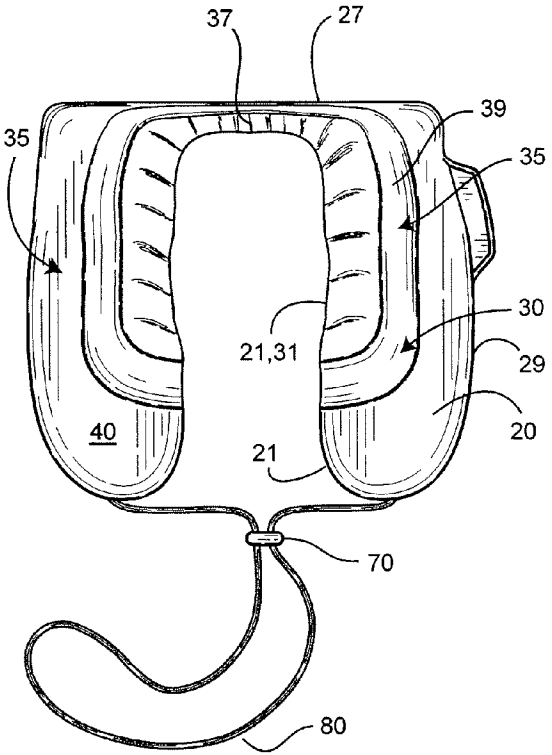
FIG. 4 is a top plan view of the embodiment of FIG. 1.

FIGS. 1 and 2 illustrate a travel pillow 10 comprising a U-shaped, pliable base cushion 20 having a top side 28, bottom side 22, outer peripheral wall 29, inner peripheral wall 21, rear wall 27, and a pair of opposing front walls 23. A U-shaped raised cushion 30 is fixed to the top side 28 of the base cushion 20. The raised cushion 30 comprises a top side 38, bottom side 32, rear wall 34 (FIG. 5), outer peripheral wall 39, and inner peripheral wall 31, all defining a rear portion 37 and two opposing side portions 35 of the raised cushion 30 (FIG. 4). The inner peripheral walls 21, 31 of the base and raised cushions 20, 30 are mutually flush, providing a comfortable surface for the neck.

Figure 3:
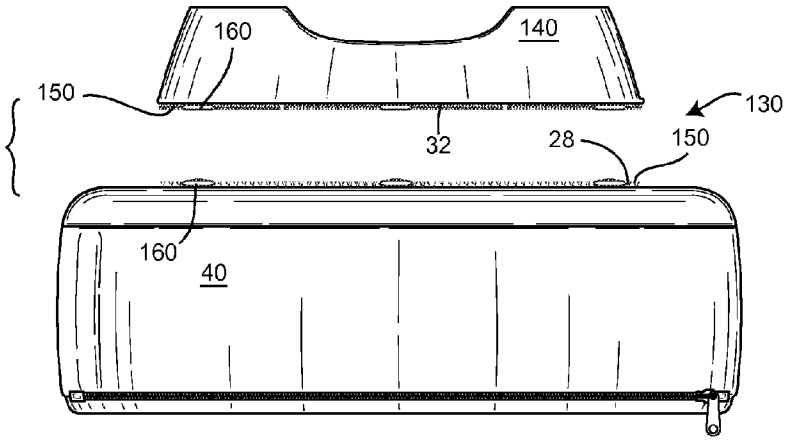
FIG. 3 is a rear elevational view of an alternate embodiment of the invention.

The top side 28 of the base cushion 20 is substantially flat, while the top side 38 of the raised cushion is curved (FIG. 2) or flat (FIG. 3) between the inner and outer peripheral walls 31, 39 thereof.

The rear walls 27, 34 of the base and raised cushions 20, 30 are mutually flush (FIG. 4) and substantially flat for better contact with flat surfaces, such as a headrest or chair (not shown). Furthermore, the outer peripheral wall 39 of the raised portion 30 may extend higher than the inner peripheral wall 31 of the opposing side portions 35 (FIG. 2), while the outer and inner peripheral walls 39, 31 of the rear portion 37 are substantially the same height. The rear portion 37 of the raised cushion 30 is thinner than each side portion 35 (FIG. 4), providing more liberty to adjust head position by easily adapting to the shape of the headrest, seat or chair.

Figure 5:
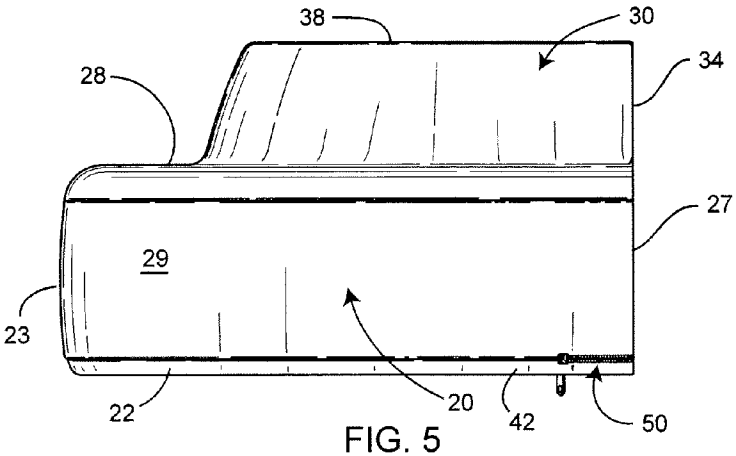
FIG. 5 is a left-side elevational view of the embodiment of FIG. 1, the drawstring omitted for clarity of illustration.

A selectively removable fabric cover 40 is adapted to cover the base and raised cushions 20,30, and includes an opening 50 at a bottom side 42 thereof (FIG. 5). In one embodiment, the fabric cover 40 is reversible, where a first side 41 of the cover 40 has a contrasting appearance to a second side 42 (FIG. 1) of the cover 40. In an alternative embodiment, the base cushion 20 and the raised cushion 30 are selectively mutually detachable (FIG. 3) at a first attachment mechanism 130, such as a zipper (not shown), two-part hook-and-loop type material 150, button, and/or mechanical snap 160. As such, the fabric cover 40 is adapted to cover the base cushion 20, while a second fabric cover 140 (FIG. 3) is adapted to cover the raised cushion 30. The fabric cover 40 may be machine washable, so as to allow for cleaning of the cover 40 from sweat or other grime.

Figure 6:
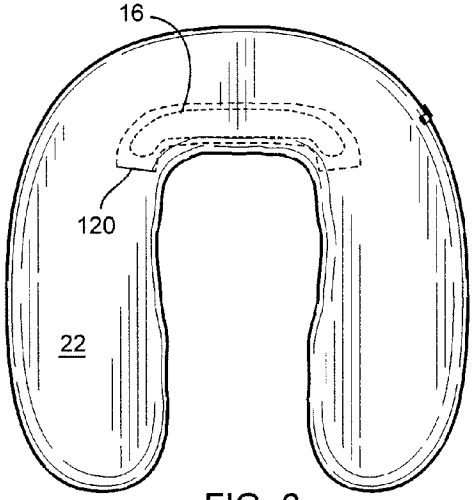
FIG. 6 is a bottom plan view of another embodiment of the invention, the drawstring omitted for clarity of illustration.

The raised cushion 30 includes a pair of opposing recesses 90 (FIG. 1) or semi-circular cut-outs (not shown) on the inner peripheral wall 31 of each side portion 35, whereby the raised cushion 30 does not interfere with a person wearing headphones. Furthermore, the outer peripheral wall 29 of the base cushion 20 includes at least one pocket 100 for holding an item 15. In an alternative embodiment, the bottom side 22 (FIG. 6) of the base cushion 20 further includes at least one pocket 120 for receiving a second item 16.

The travel pillow 10 can be used in a first position, where the user can lay his head back on the device 10, or a second position 180-degrees rotated, where the user's chin is supported at a chin support 170 (FIG. 1). Clearly the user can rotate the travel pillow 10 to any suitable and comfortably position as needed, the raised cushion 30 providing varying heights of support to the user's neck and chin. To provide more customization, a drawstring 60 is adapted to adjust the fitting of the travel pillow 10 around the neck. The drawstring 60 has opposing ends 65, each end fixed proximate one of the front walls 23 of the base cushion 20.

The drawstring 60 further comprises an adjustable cinch mechanism 70 for adjusting the tension in the drawstring 60. The cinch mechanism 70 may be adjusted until the front peripheral walls 23 of the base cushion 20 are brought into mutual contact. As such, the travel pillow 10 may be further used as a massage pillow wherein the raised cushion 30 supports the user's face while allowing the user to breathe freely and lay on his stomach. Alternately, the travel pillow 10 in such a configuration may be used as a so-called "massage" or "sun tanning" support for a user's face or the back of the user's head, respectively, while laying either face-down or face-up on a surface.

The U-shape of the travel pillow 10 is generally intended to providing support to the head while traveling. As such, the base cushion 20 and raised cushion 30, in one embodiment, are integrally formed from a foam material 110 adapted to fit securely, yet comfortably, around the neck, providing adequate ergonomic support to the head when seated in an upright position. In the preferred embodiment, the foam material 110 is a memory foam material, with the device 10 having overall dimensions of 10"×10"×5", although any suitable material and size may be used. Other materials include fabrics, air, beads, polyester, grains, aromatherapy material, gels, and other fluids.

While a particular form of the invention has been illustrated and described, it will be apparent that various modifications can be made without departing from the spirit and scope of the invention. For example, an electrical heating and massaging device may be incorporated to provide heat and massage to the neck. Additionally, the travel pillow 10 may be shaped like an animal, cartoon character, sports team logo, or other novelty shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A travel pillow, comprising:

a first base side portion comprising a first base inner surface, a first base outer surface, and a first base front wall between said first base inner surface and said first base outer surface;

a first raised side portion integral with said first base side portion, said first raised side portion comprising a first raised top surface, said first raised top surface being a first substantially flat top surface having a first height;

a second base side portion comprising a second base inner surface, a second base outer surface, and a second base front wall between said second base inner surface and said second base outer surface;

a second raised side portion integral with said second base side portion, said second raised side portion comprising a second raised top surface said second raised top surface being a second substantially flat top surface that is substantially coplanar with said first substantially flat top surface at said first height;

a rear base portion between said first and second base side portions, said rear base portion comprising a rear base inner surface and a rear base outer surface, said rear base inner surface between said first and second base inner surfaces, and said rear base outer surface between said first and second base outer surfaces;

a rear raised portion integral with said rear base portion, said rear raised portion comprising a rear raised inner surface, a rear raised outer surface, and a rear raised top surface, said rear raised top surface shaped to define a dip between said first raised top surface and said second raised top surface;

a first base curved transition between said rear base outer surface and said first base outer surface; and a second base curved transition between said rear base outer surface and said second base outer surface;

wherein said first base side portion, said second base side portion, and said rear base portion define a substantially U-shaped base cushion extending in a first plane, and wherein said first raised side portion, said second raised side portion, and said rear raised portion define a substantially U-shaped raised cushion extending in a second plane substantially parallel to said first plane;

wherein said first raised side portion covers less than all of a top surface of said first base side portion, and said second raised side portion covers less than all of a top surface of said second base side portion;

wherein said rear base portion is thinner than each of said first and second base side portions;

wherein said rear raised portion is thinner than each of said first and second raised side portions;

wherein said rear base inner surface and said rear raised inner surface are mutually flush;

wherein said pillow is substantially flat for a continuous majority of a distance from a bottom end of said rear base outer surface to a top end of said rear raised outer surface;

wherein said rear base outer surface comprises a rear base outer surface left end and a rear base outer surface right end;

wherein said rear base outer surface is substantially flat from said rear base outer surface left end to said rear base outer surface right end;

wherein the distance from said rear base outer surface left end to said rear base outer surface right end is greater than half the total width of said pillow;

wherein said rear raised outer surface comprises a rear raised outer surface left end and a rear raised outer surface right end; and wherein said rear raised outer surface is substantially flat from said rear raised outer surface left end to said rear raised outer surface right end.

2. The travel pillow of claim 1, wherein at least a portion of said rear raised top surface is flat.

3. The travel pillow of claim 1, wherein said dip is configured to act as a chin support when said pillow is used in a 180-degrees rotated position.

4. The travel pillow of claim 1, wherein said dip has a minimum height located approximately halfway between said first and second raised side portions.

5. The travel pillow of claim 1, further comprising:

a first raised curved transition between said rear raised outer surface and said first raised outer surface; and a second raised curved transition between said rear raised outer surface and said second raised outer surface.

* * * * *